United States Patent [19]

Foerster

[11] Patent Number: 4,659,377

[45] Date of Patent: Apr. 21, 1987

[54] METHOD FOR PRODUCING AN OXIDATION RESISTANT MAGNESIUM ALLOY MELT

[75] Inventor: George Foerster, Greeneville, Tenn.

[73] Assignee: NL Industries, Inc., New York, N.Y.

[21] Appl. No.: 779,235

[22] Filed: Sep. 23, 1985

Related U.S. Application Data

[60] Division of Ser. No. 427,752, Sep. 29, 1982, Pat. No. 4,543,234, which is a continuation-in-part of Ser. No. 195,236, Oct. 20, 1980, abandoned, which is a continuation-in-part of Ser. No. 41,802, May 23, 1979, abandoned.

[51] Int. Cl.[4] ..... C22B 9/00

[52] U.S. Cl. ..... 75/96; 420/409; 420/590

[58] Field of Search ..... 75/67 R, 67 A, 96; 420/590, 402, 407–409, 410, 413, 412

[56] References Cited

U.S. PATENT DOCUMENTS

| | | | |
|---|---|---|---|
| 2,380,200 | 7/1945 | Stroup et al. | 75/168 |
| 2,380,201 | 7/1945 | Stroup et al. | 22/200 |
| 2,461,229 | 2/1949 | Murphy et al. | 75/168 |
| 2,844,463 | 3/1976 | Lucien | 75/168 |
| 3,947,268 | 3/1976 | Tikhonova et al. | 75/168 |

FOREIGN PATENT DOCUMENTS

| | | |
|---|---|---|
| 143256 | 11/1947 | Australia . |
| 506990 | 3/1953 | Belgium . |
| 1027410 | 4/1958 | Fed. Rep. of Germany . |
| 1358229 | 3/1964 | France . |
| 904906 | 9/1962 | United Kingdom . |
| 963073 | 7/1964 | United Kingdom . |
| 2085471 | 4/1982 | United Kingdom . |
| 206837 | 8/1978 | U.S.S.R. . |

OTHER PUBLICATIONS

Burns, J. R., "Beryllium in Magnesium Casting Alloys", Trans. ASM, vol. 40, 1948, pp. 1–19 (Preprint), 143–162.

Burkett, F. L., "Beryllium in Magnesium Die Casting Alloys", AFS Trans., vol. 62, 1954, pp. 2–4.

Foerster, Paper No. G-T75-112, 8th SDCE International Die Casting Exposition & Congress, Detroit, Mich. 1975 (pp. 1–6).

*Primary Examiner*—Christopher W. Brody

*Attorney, Agent, or Firm*—John C. Purdue

[57] ABSTRACT

A method for producing a magnesium alloy melt is disclosed. The method comprises the steps of (a) melting a magnesium alloy consisting essentially of up to 12 percent of aluminum, up to 30 percent of zinc, up to 1.5 percent of silicon, from 0.04 percent to 0.15 percent of manganese, and a given amount of dissolved beryllium, the given amount constituting from 0.0025 percent to 0.0125 percent of the alloy, balance essentially magnesium, and (b) protecting the magnesium alloy melt against oxidation by blanketing it with an atmosphere containing at least 80 percent by volume of nitrogen. A magnesium alloy melt produced in accordance with the method of the instant invention will undergo reduced oxidation by comparison with magnesium alloy melts produced in accordance with prior art methods. A method for producing a die-casting from a magnesium alloy melt produced according to the method of the instant invention is also disclosed.

8 Claims, No Drawings

METHOD FOR PRODUCING AN OXIDATION RESISTANT MAGNESIUM ALLOY MELT

REFERENCE TO RELATED APPLICATIONS

This is a division of copending application Ser. No. 427,752, filed Sept. 29, 1982, now U.S. Pat. No. 4,543,234 which application was a continuation in part of application Ser. No. 195,236 filed Oct. 10, 1980 now abandoned, which in turn was a continuation-in-part of application Ser. No. 41,802, filed May 23, 1979 now abandoned.

FIELD OF THE INVENTION

The invention generally relates to magnesium alloys that contain beryllium and are sufficiently resistant to oxidation in the molten condition to obviate the use of protective flux covers to prevent excessive oxidation and burning of the molten alloy when exposed to oxygen-containing atmospheres. Beryllium functions to reduce the propensity of molten magnesium alloys to oxidize when exposed to oxygen-containing atmospheres such as air.

The elimination of the need to employ a protective flux cover for molten magnesium alloys is advantageous for several reasons. First of all, the elimination of flux covers results in a significant cost reduction. In addition, the absence of flux covers means that flux particles cannot become mixed into the molten magnesium metal and then become trapped in the resultant casting in the form of flux inclusions. The absence of flux covers also results in increased magnesium yields because entrapment and subsequent loss of molten magnesium in the flux covering are eliminated.

DESCRIPTION OF THE PRIOR ART

It is known in the art to add beryllium to magnesium base alloys for various purposes. U.S. Pat. Nos. 2,380,200; 2,380,201; 2,383,281; 2,461,229; and 3,947,268 and an article by F. L. Burkett entitled "Beryllium in Magnesium Die Casting Alloys" which appeared in AFS Transactions, Volume 62, pages 2–4 (1954) disclose the addition of beryllium to magnesium base alloys. Of the above cited documents, U.S. Pat. Nos. 2,380,200 and 2,380,201 and the Burkett article teach that beryllium reduces the propensity for molten magnesium alloys to oxidize. These prior efforts to reduce oxidation, however, do not involve beryllium additives at the levels of the instant invention and do not appear to involve the imposition of a restriction of manganese content to increase beryllium solubility in the magnesium alloy. Moreover, the Burkett article suggests that higher beryllium levels must be avoided.

SUMMARY OF THE INVENTION

The instant invention is based upon the discovery that the manganese content of magnesium alloys has a significant influence upon the solubility and ease of alloying of beryllium therein. Because this influence was not heretofore recognized, AZ91B, a widely used die casting alloy having a nominal composition of 9 percent aluminum, 0.7 percent zinc, 0.2 percent manganese, 0.5 percent silicon maximum, 0.3 percent copper maximum, 0.03 percent nickel maximum, balance essentially magnesium, has contained less than 0.001 percent beryllium. (All compositional percentages in this specification and the appended claims are in terms of weight percent.) It has been discovered that when the manganese content is reduced below 0.2 percent, beryllium is soluble in magnesium alloys to an extent greater than previously believed. In any event, a beryllium content of on the order of 0.001 percent is considered to be inadequate for the purpose of inhibiting excessive oxidation of the molten magnesium. Rather, it has been determined that from 0.0025 percent to 0.0125 percent of beryllium should be dissolved in molten magnesium alloys to inhibit burning, with the amount of beryllium being increased with increasing oxygen content of the atmosphere. Accordingly, the manganese content should not exceed more than about 0.18 percent, preferably no more than about 0.15 percent. When nitrogen atmospheres and short exposure times are involved, additions of from about 0.0025 percent to 0.005 percent beryllium are sufficient to provide protection of molten magnesium. However, when longer exposure times or significant air leakage into the nitrogen atmosphere occurs, beryllium contents on the order of from about 0.005 percent to 0.01 percent are recommended. On the other hand, should it be desired to inhibit the burning of molten magnesium or magnesium alloys held in air, a beryllium content of about 0.011 percent to 0.0125 percent is preferred. Such beryllium contents require manganese to be restricted to no more than about 0.05 percent.

The magnesium alloys of the instant invention comprise up to about 12 percent aluminum, up to about 30 percent zinc, up to about 1.5 percent silicon, not more than 0.15 percent manganese, from about 0.0025 percent to 0.0125 percent beryllium, balance essentially magnesium. When the beryllium content ranges between 0.011 percent and 0.0125 percent, it is preferred to restrict the manganese content to a maximum of about 0.05 percent so that the indicated amounts of beryllium can be dissolved in the magnesium alloy. About 0.15 percent manganese will permit the dissolution of about 0.007 percent beryllium in molten magnesium.

Magnesium alloys containing from 0.08 percent to 0.15 percent manganese and from 0.006 percent to 0.01 percent beryllium have been found to have excellent corrosion resistance.

The above-mentioned principles of the invention are readily applied to the production of magnesium alloy die castings. Conventional magnesium die casting alloys may contain from 1 percent to 12 percent aluminum, up to about 30 percent zinc, up to 1.5 percent silicon, from 0.2 percent to 1.0 percent manganese, balance essentially magnesium.

DESCRIPTION OF THE PREFERRED EMBODIMENTS

As previously indicated, the beryllium level used depends upon the amount of oxygen in the atmosphere over the melt. For example, if the molten magnesium is exposed to air without a cover, the oxygen content of the atmosphere will remain at about 20 percent, and, accordingly, high beryllium levels, on the order of 0.01 percent to 0.0125 percent, will be needed to avoid excessive oxidation or burning. Should the molten magnesium be exposed for prolonged periods, it may be desirable to add beryllium periodically to compensate for beryllium that is oxidized, e.g., 0.02 percent, in order that the excess above the solubility limit will gradually dissolve to compensate for oxidation losses and thereby maintain the beryllium at or close to the saturation level in the molten magnesium.

To reduce the beryllium level required for good melt protection it is desirable to keep the oxygen level as low as practical. Placement of a lid or hood over the molten magnesium is helpful in this regard. Reaction of the molten metal with oxygen in the enclosed air will lower the oxygen content of the atmosphere. If the system is very tight and the resultant oxygen content becomes very low, beryllium levels as low as 0.0025 percent will provide adequate protection. If the system is not tight or is periodically opened for brief periods for operations such as ladling, it may be desirable to introduce sufficient nitrogen or other inert gases to maintain the low oxygen contents. In such situations an intermediate beryllium level, e.g., 0.005 percent to 0.01 percent, may be used. Other protective gases such as $SF_6$, $SO_2$, and various inert gases may also be used, although nitrogen is preferred due to its relative availability.

Impurities such as iron tend to form insoluble intermetallic compounds with beryllium and accordingly should be minimized. Because manganese, in magnesium alloys having aluminum contents on the order of 1 percent to 12 percent, forms a relatively insoluble phase with iron which then settles to the bottom of the melt, small quantities of manganese such as 0.1 percent may be included in die casting alloys for purification purposes. However, the manganese level should not be high enough to precipitate beryllium. In magnesium alloys containing about 9 percent aluminum, it has been found that manganese contents should be decreased from 0.15 percent to 0.04 percent as the amount of beryllium increases from 0.0025 percent to 0.0125 percent.

The zinc content of magnesium alloys has generally been limited to a maximum of 1.5 percent zinc. Zinc at levels up to 1.5 percent in a magnesium alloy improves the mechanical properties and corrosion resistance of the alloy while maintaining very good die casting properties. Some magnesium alloys having a zinc content above 1.5 percent show a marked increase in hot shortness or cracking during casting. In fact, casting of magnesium alloys containing 1 percent aluminum presents problems when the zinc content is above 1.5 percent and below 12 percent. Casting of magnesium alloys containing 10 percent aluminum is a problem when the zinc content is above 1.5 percent and below 5 percent. This is due to a broadening of the solidification temperature range. There is, however, a group of castable magnesium alloys containing from 5 percent to 30 percent of zinc. The influence of the aluminum and zinc contents of magnesium alloys on their castability is shown graphically in FIG. 2 of Paper No. G-T75-112, entitled "Improved Magnesium Die-casting Alloys". This paper was prepared for the 8th SDCE International Die-casting Exposition and Congress, Mar. 17–20, 1975. As shown in FIG. 2, magnesium alloys containing between about 12 percent and about 30 percent zinc are castable. As also shown in FIG. 2, some magnesium alloys containing between about 5 percent and about 12 percent zinc are castable, while others are not, depending upon the aluminum content.

Castable magnesium alloys with zinc contents greater than 5 percent have advantages and disadvantages. The advantages of these alloys include lower melting points and greater fluidity. These advantages combine, depending on the zinc content, to enable casting at a temperature of 50° to 100° F. lower than that generally employed in casting low zinc magnesium alloys, while still maintaining good fluidity. The low melting point additionally increases oxidation resistance of the magnesium alloys during casting. Magnesium alloys having zinc contents greater than 5 percent may have problems with castability, density, ductility, and increased cost. As the zinc content in magnesium alloys increases, so do their density, cost, and brittleness. The problems with the high zinc alloys are offset by the benefits derived from their use in certain applications. Therefore, care must be taken in recommending the appropriate high zinc alloy for any intended use.

The following experimental results illustrate certain of the principles of the invention.

A magnesium test alloy containing about 9 percent aluminum, about 0.7 percent zinc, and about 0.0025 percent beryllium was held under a hood for 8 hours without burning or excessive oxidation.

A 130 lb. batch of an alloy containing 7.1 percent aluminum, 0.71 percent zinc, 0.05 percent manganese, balance magnesium was melted, covered with a flux and held under a hood at 1250° F. One minute after the flux was removed by skimming, burning of the molten alloy occurred. The burning alloy was then extinguished with the establishment of a flux cover. The hood was closed and nitrogen was flooded over the surface of the flux-covered molten bath at a rate of 30 cfh for about 5 minutes. The hood was closed, the flux cover removed, and nitrogen flow was continued at a rate of 30 cfh. After 30 minutes, blooms (localized areas of high oxidation) began to form and increase in size. After 51 minutes the blooms began to burn slowly and emit a bright light. The hood door was then briefly opened periodically to permit ladling and casting of test bars. Burning became more vigorous after 5 minutes of casting and very intense after 15 minutes.

Additional tests were conducted by adding various amounts of beryllium to the molten magnesium test alloy described in the preceding paragraph. In general, the tests indicated that beryllium additions decrease the tendency of the molten alloy to burn. When on the order of 0.008 percent beryllium was incorporated, the alloy was held satisfactorily under a 30 cfh nitrogen flow and then die cast into test bars. This alloy was also held in air without burning for approximately 15 minutes. As the beryllium content was increased during the various tests, it was noted that the oxidation resistance of the molten magnesium alloy increased and that lessened rates of nitrogen flow were required for satisfactory operations. When about 0.011 percent to 0.013 percent beryllium was incorporated into the molten alloy, the surface of the alloy became silvery in appearance and was satisfactorily held under exposure to air and then die cast. When the silvery protective surface film was deliberately disrupted, a new film formed instantly, indicating that the protective function of beryllium was still operative. Following exposure to air for about 1 hour, however, oxide blooms began to form and grow slowly.

When 0.0025 percent beryllium was alloyed into the magnesium test alloy, the melt was satisfactorily held under a nitrogen flow of 30 cfh with door closed and then was cast into test bars. Following 15 minutes, the molten magnesium alloy was heavily bloomed and commenced burning. When 0.007 percent to 0.001 percent beryllium was alloyed, the casting run was successfully completed without the occurrence of blooming with 60 cfh nitrogen. The door of the hood was then held open for 15 minutes without bloom formation. Nitrogen flow was then stopped and the molten alloy was held for an additional 15 minutes without bloom formation. After the alloy was saturated with about 120–130 ppm beryllium at 1200°–1300° F., it was held in air with the door open for over 30 minutes without bloom formation and was then successfully cast without a nitrogen atmosphere. Extended holding, however, finally lead to bloom formation.

To determine the compatibility of manganese and beryllium in magnesium alloys, two AZ91B ingots containing about 0.2 percent manganese were added to the melt which was saturated with beryllium. This addition reduced the beryllium content to about 0.008 percent and increased the manganese content to 0.12 percent. The molten alloy was successfully die cast with a flow of 60 cfh nitrogen and the hood door opened only as required. A portion of the melt was poured in air into a large ingot mold. No discoloration was noted on the surface of the metal as it slowly solidified.

Another AZ91B ingot was added to the molten alloy with a resultant lowering of the beryllium content to about 0.007 percent and an increase in the manganese level to about 0.15 percent. Test bars were again cast under 60 cfh of nitrogen. Several blooms had formed at the end of the run.

The variations in manganese and beryllium levels had little apparent effect upon the castability of the magnesium test alloy. Some improvement in fluidity and surface appearance appears to result from increasing beryllium content because of less oxidation of the molten material.

Five die cast bars of each alloy were tested in tension to determine the effect of beryllium and manganese. The results set forth in Table I indicate that lower manganese and higher beryllium function to increase both the ductility and the tensile strength of the magnesium test alloy.

Test bars of each alloy were sanded to remove the cast surface. The sanded test bars were immersed in salt water (3 percent NaCl) for 3 days to evaluate their corrosion resistance. The results in Table I indicate that beryllium additions reduced the salt water corrosion rate of the magnesium test alloy to the same low level obtained by manganese additions. Small amounts of manganese, e.g., 0.12 percent reduce the amount of beryllium required for good corrosion resistance. The improvement effected by beryllium additions can be attributed to a consequential reduction in iron content.

TABLE I

| % Be | % Mn | % Fe | Corrosion Rate-IPY* | % E | TYS** | TS** |
|---|---|---|---|---|---|---|
| — | 0.05 | 0.015 | 1.30 | 6 | 21,500 | 36,300 |
| 0.0025 | 0.05 | 0.015 | 0.95 | 7 | 22,900 | 38,900 |
| 0.0086 | 0.05 | 0.008 | 0.17 | 6 | 22,700 | 36,800 |
| 0.0113 | 0.04 | 0.005 | 0.03 | 7 | 21,000 | 38,200 |
| 0.0125 | 0.04 | 0.005 | 0.03 | 5 | 22,000 | 37,800 |
| 0.0081 | 0.12 | 0.006 | 0.03 | 6 | 22,700 | 39,000 |
| 0.0071 | 0.15 | 0.007 | 0.03 | 8 | 21,900 | 40,500 |
| 0.0006*** | 0.2 | 0.003 | 0.03 | 4 | 21,700 | 34,600 |

*Inches Per Year
**Pounds per Square Inch
***(AZ91B)

What I claim is:

1. A method of producing a magnesium alloy melt, comprising the steps of:

a. melting a magnesium alloy characterized by having good resistance to oxidation in the molten state, good corrosion resistance and good tensile strength, said alloy consisting essentially of up to 12 percent of aluminum, up to 30 percent of zinc, up to 1.5 percent of silicon, from 0.04 percent to 0.15 percent of manganese, and a given amount of dissolved beryllium, the given amount constituting from 0.0025 percent to 0.0125 percent of the alloy, balance essentially magnesium, wherein the manganese content of the alloy is sufficiently low that it does not prevent dissolution of the given amount of beryllium and wherein the relative proportions of aluminum and zinc are such that the alloy is castable and ductile, and is not subject to hot cracking; and b. protecting the magnesium alloy melt against oxidation by blanketing it with an atmosphere containing at least 80 percent by volume of nitrogen.

2. The method of claim 1, wherein said nitrogen-containing atmosphere contains a greater proportion of nitrogen than that contained in air.

3. The method of claim 2, wherein said magnesium alloy contains from about 0.005 percent to 0.01 percent of dissolved beryllium.

4. The method of claim 1, wherein said magnesium alloy contains from about 0.01 percent to 0.0125 percent of dissolved beryllium and up to 0.05 percent of manganese and said molten magnesium alloy is blanketed by air.

5. A method of producing a magnesium alloy casting, comprising the steps of:

a. providing a molten pool of a magnesium alloy characterized by having good resistance to oxidation in the molten state, good corrosion resistance and good tensile strength, said alloy consisting essentially of up to 12 percent of aluminum, up to 30 percent of zinc, up to 1.5 percent of silicon, not more than 0.15 percent of manganese, and a given amount of dissolved beryllium, the given amount constituting from 0.0025 percent to 0.0125 percent of the alloy, balance essentially magnesium, and wherein the manganese content of the alloy is sufficiently low that it does not prevent dissolution of the given amount of beryllium and wherein the relative proportions of aluminum and zinc are such that alloy is castable and ductile, and is not subject to hot cracking;

b. protecting said molten pool against oxidation by blanketing it with an atmosphere containing at least 80 percent by volume of nitrogen; and c. casting said molten magnesium alloy to form a casting characterized by being essentially free of flux inclusions.

6. The method of claim 5, wherein said nitrogen-containing atmosphere contains a greater proportion of nitrogen than that contained in air.

7. The method of claim 6, wherein said magnesium alloy contains from about 0.005 percent to 0.01 percent of dissolved beryllium.

8. The method of claim 5, wherein said magnesium alloy contains from about 0.01 percent to 0.0125 percent of dissolved beryllium and up to 0.05 percent of manganese and said molten pool is blanketed by air.

* * * * *

UNITED STATES PATENT AND TRADEMARK OFFICE

CERTIFICATE OF CORRECTION

PATENT NO. : 4,659,377

DATED : April 21, 1987

INVENTOR(S) : George Foerster

It is certified that error appears in the above-identified patent and that said Letters Patent are hereby corrected as shown below:

On the Title Page:

At [73] the name of the Assignee should be Farley Metals, Inc. of Chicago, Illinois

Signed and Sealed this

Ninth Day of February, 1988

*Attest:*

DONALD J. QUIGG

*Attesting Officer*

*Commissioner of Patents and Trademarks*